US006098381A

United States Patent [19]

Schmelzer

[11] Patent Number: 6,098,381

[45] Date of Patent: Aug. 8, 2000

[54] MACHINE FOR HANDLING CONTAINERS

[75] Inventor: Stephan Schmelzer, Sandton, South Africa

[73] Assignee: Krones AG, Neutraubling, Germany

[21] Appl. No.: 09/281,539

[22] Filed: Mar. 30, 1999

[30] Foreign Application Priority Data

Apr. 16, 1998 [DE] Germany ..... 298 06 838 U

[51] Int. Cl.[7] ..... B65B 53/02

[52] U.S. Cl. ..... 53/557; 53/77

[58] Field of Search ..... 53/557, 442, 585, 53/291, 292, 295, 253, 77; 34/216, 428, 429, 430, 431, 432, 433, 434, 435; 156/86; 29/447

[56] References Cited

U.S. PATENT DOCUMENTS 4,172,873 10/1979 Spicer ..... 156/86
4,447,280 5/1984 Malthouse .
4,579,614 4/1986 Burmeister et al. ..... 53/446
5,031,298 7/1991 Fresnel ..... 29/447
5,464,495 11/1995 Eder .

*Primary Examiner*—Peter Vo
*Assistant Examiner*—Louis F. Huynh
*Attorney, Agent, or Firm*—Tilton, Fallon, Lungmus & Chestnut

[57] ABSTRACT

A heat shield, in the form of a blower, oriented between a heat source and a plurality of containers, interrupts the heat transmission onto fittings and the containers. The heat source is in the form of a hot air fan. The blower produces an air curtain between the containers and the hot air fan. The machine has a conveyor along which the blower runs on one side and parallel with it. The tubular blower has openings or nozzles in, and is switched on or off by, a control and a control valve.

3 Claims, 3 Drawing Sheets

MACHINE FOR HANDLING CONTAINERS

FIELD OF THE INVENTION

The invention pertains to a machine for handling containers, with a heat source to shrink wrapping material onto the contour of the container.

BACKGROUND OF THE INVENTION

From U.S. Pat. Nos 5,464,495 and 4,447,280, for example, it is known that containers such as cans, bottles or the like can be wrapped with shrink material, whereby the material projects beyond areas that are formed radially inward (bottom or shoulder) after it is wound on. In order to form these projecting areas of the wrapping material onto the contour of the container, a local heat treatment takes place with hot air, causing the material to shrink radially inwardly until it snugly fits the container surface. In the process, at no time may the wrapping material become overheated, in order to avoid pleat or bubble formation.

For containers that are sensitive to heat, specifically thin-walled plastic surfaces comprising polyethylene terephthalate or another type of material, in particular situations the influence of heat that is applied for too long a period of time can cause disadvantages such as the deformation of the container. This situation, above all, can arise during an emergency stoppage of the machine when the machine needs to be stopped immediately as a result of a fault in the machine, so that containers that are still located in the machine prior to the stoppage can no longer be guided out. Even if the hot air that is generated is switched off immediately, the residual heat of the blower and the energy stored in the blower housing is so great that a deformation of the container that is still in the machine can occur, even with an increase in the distance of the hot air blower relative to the containers.

SUMMARY OF THE INVENTION

As a consequence of this, the invention has the basic task of improving the known machine such that damage to the container and/or to the wrapping material as a result of the influence of heat can be eliminated.

This task is accomplished in that the heat transfer onto the wrapping material and the container can be interrupted my means of heat shielding that can be controlled between the containers and the heat source. Heat shielding advantageously forestalls any further supply of heat by the heat source in the shortest time and with little expense when, in specific situations, e.g. a sudden stoppage of the machine, heat transfer must no longer take place.

The heat shielding can be provided, for example, as a simply designed blower device that can generate a controlled stream of air between the bottle and the heat source.

During normal operation the heat shielding does not operate until the heat supply needs to be interrupted. For this purpose, according to a further development of the invention, in the case where a blower device is used as the heat shielding, a control valve that is actuated, for example, by the machine control, releases the compressed air supply of the blower device when the machine is stopped, while in any other case the control valve remains closed and thereby the blower device is not active.

A pipe with bore holes or nozzles can be used as a blower device, arranged above and/or below the area of the container that receives the wrapping material on the side of the container transport path that is directed toward the hot air blower such that the compressed air that exits the bore holes or the nozzles at nearly room temperature flows transverse to the direction of flow of the hot air and carries this along with it before it can reach a container.

BRIEF DESCRIPTION OF THE DRAWINGS

A preferred design is explained in the following on the basis of the figures. Shown are.

DETAILED DESCRIPTION OF THE INVENTION

Figure 1:
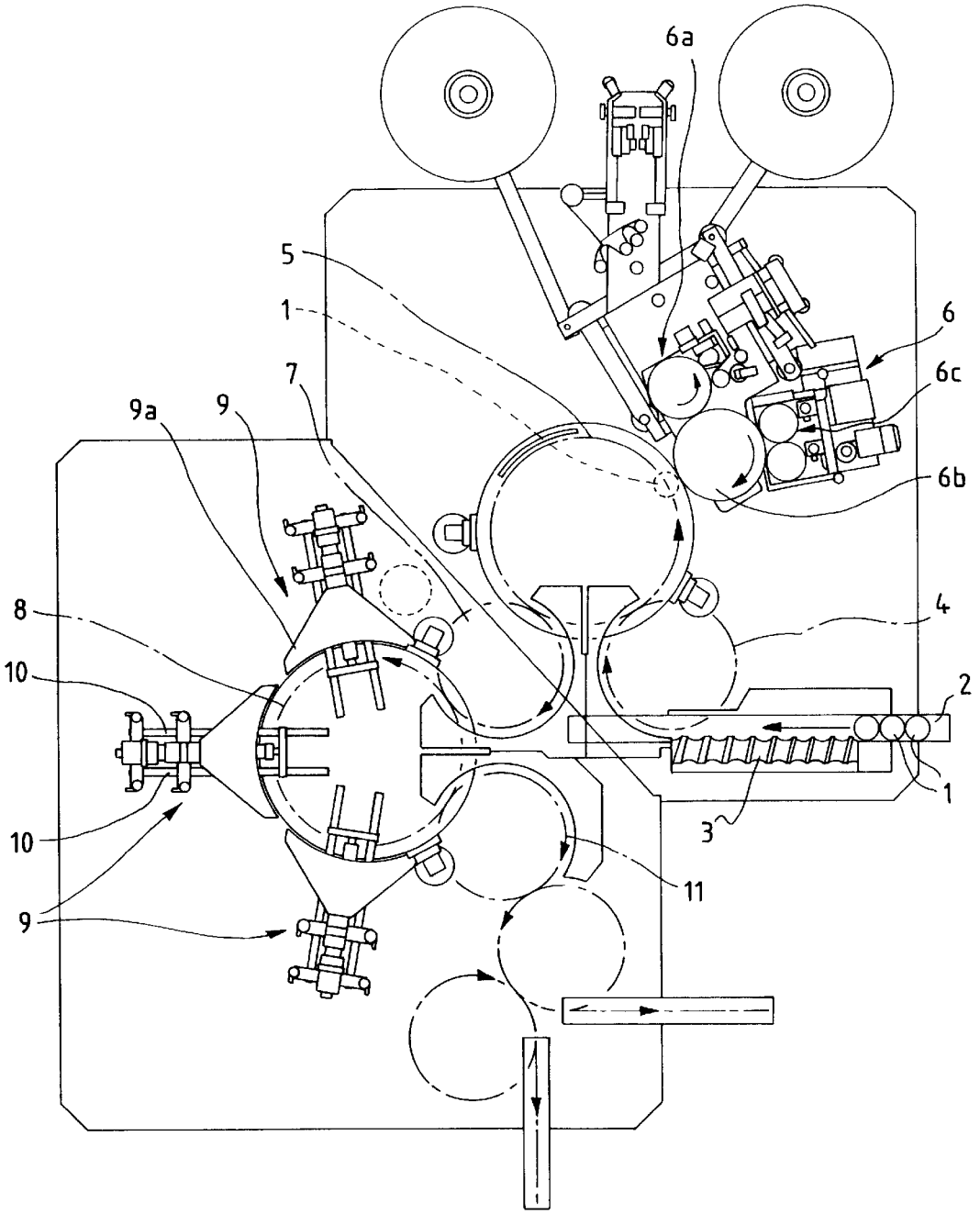
FIG. 1 a machine for applying wrapping, in a schematic top view with a device to shrink the wrapping material.

FIG. 1 shows a machine for continuously providing bottles 1 or the like with a circumferential label comprising shrink material. For this purpose the bottles 1 that are to be wrapped are supplied to a driven endless screw 3 by means of a conveyor 2 in a series without gaps, separated from here on the machine subdivider and passed on to a succeeding inlet star wheel 4 indicated simply as a dot-dashed circle, which transfers the bottles to a circulating rotary table 5. On the periphery of the rotary table 5 there is a labeling aggregate 6 with a cutting device 6*a* to separate the individual labels from the band of labels. The individual labels then pass a glue station 6*c* from a transfer cylinder 6*b*, thereby, e.g., being glued at their leading and trailing edge areas and then wrapped onto a passing bottle 1 that rotates around its vertical axis, whereby the end of the label possibly overlaps the end edge and is fastened onto it. In order to mutually attach the label edges in the overlapping area a solvent, a hot sealing tool or the like can be used.

Figure 2:
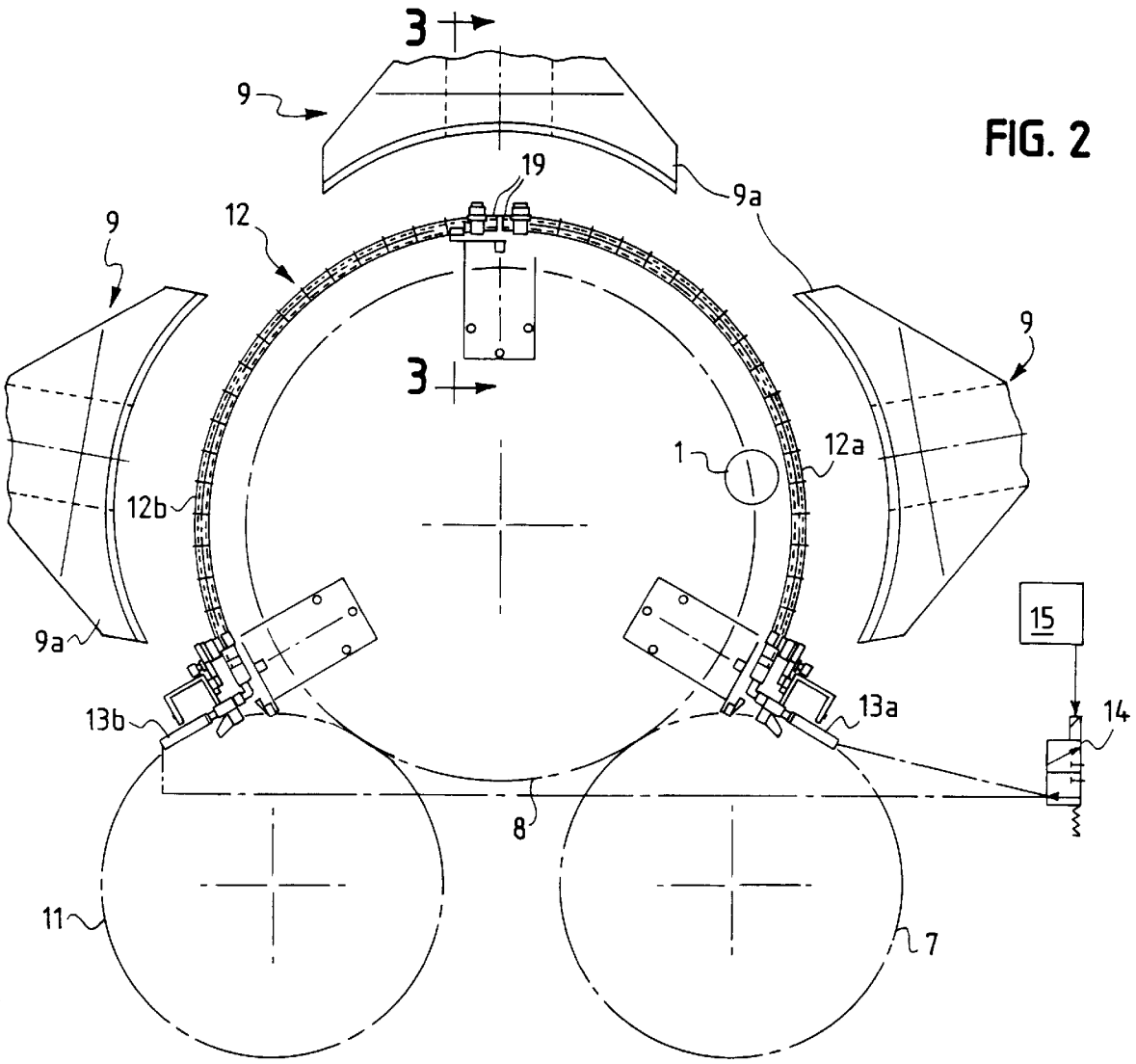
FIG. 2 the shrink device according to FIG. 1 in enlarged illustration.

After wrapping on the label, the bottle is then transferred by a transfer star wheel 7 from the rotary table 5 to a shrink carousel 8, on the periphery of which are located three hot air blowers 9 with curve-shaped slot nozzles 9*a*, displaced in succession in the circumferential direction. Each of the hot air blowers can be transferred radially with regard to a carousel 8 from a work position that is near it, as can be seen in FIG. 1, on a carriage that is formed by two parallel rods 10, into a position that is non-operational and is radially distant from the work position, according to FIG. 2, and the reverse, by means of a controlled actuating drive that is not illustrated in greater detail. The slot nozzles 9*a* are allocated relative to height to the sections 20*a*, 20*b* of the wrapping material 20 that has not as yet been applied to the bottle contour (see FIG. 3), as is already known from U.S. Pat. No. 5,464,495 (FIGS. 13 to 15) indicated above. From the enlarged illustration in FIG. 2 it can be seen that, in addition to the slot nozzles 9*a* of the hot air blower 9, there is also a curved pipe 12 located near the outer side of the bottle circulating path or of the carousel 8. This pipe, surrounding the shrink carousel 8 and comprising two individual elbow pipes 12*a* and 12*b*, extends from the transfer star wheel 7 to an outlet star wheel 11 and can be supplied with compressed air at two ends by means of connection lines 13*a* and 13*b*. The ends of the elbow pipes 12*a*, 12*b* opposite the connection lines are closed off in a gas-tight manner with stopper 19. A plurality of bore holes 21 are located in a series on the underside of the pipe, spaced in succession and equidistant along the longitudinal axis of the pipe, said bore holes designed such that the exiting air flows in an axial direction relative to the longitudinal axis of the bottle, displaced laterally parallel to this, transverse to the blowing direction of the slot nozzles 9*a*, and forming a curtain of air 22 between the bottle 1 and the slot nozzles 9*a* when the further supply of heat, e.g. as during a sudden stoppage of the machine, needs to be forestalled in order to avoid bottle deformations (see FIG. 3). In such case the compressed air supply to the elbow pipes 12*a*, 12*b* is released by the control valves 1, which can be controlled by the machine control 15, and the hot air blowers 9 are switched off and/or moved away radially outward from their actuating drives into the prepared position (FIG. 2) that is farther from the carousel 8. The duration of blowing can be limited to a predetermined quantity of time in order to avoid any unnecessary consumption of air. It is further possible to control the supply of compressed air in both elbow pipes in alternating fashion.

Figure 3:
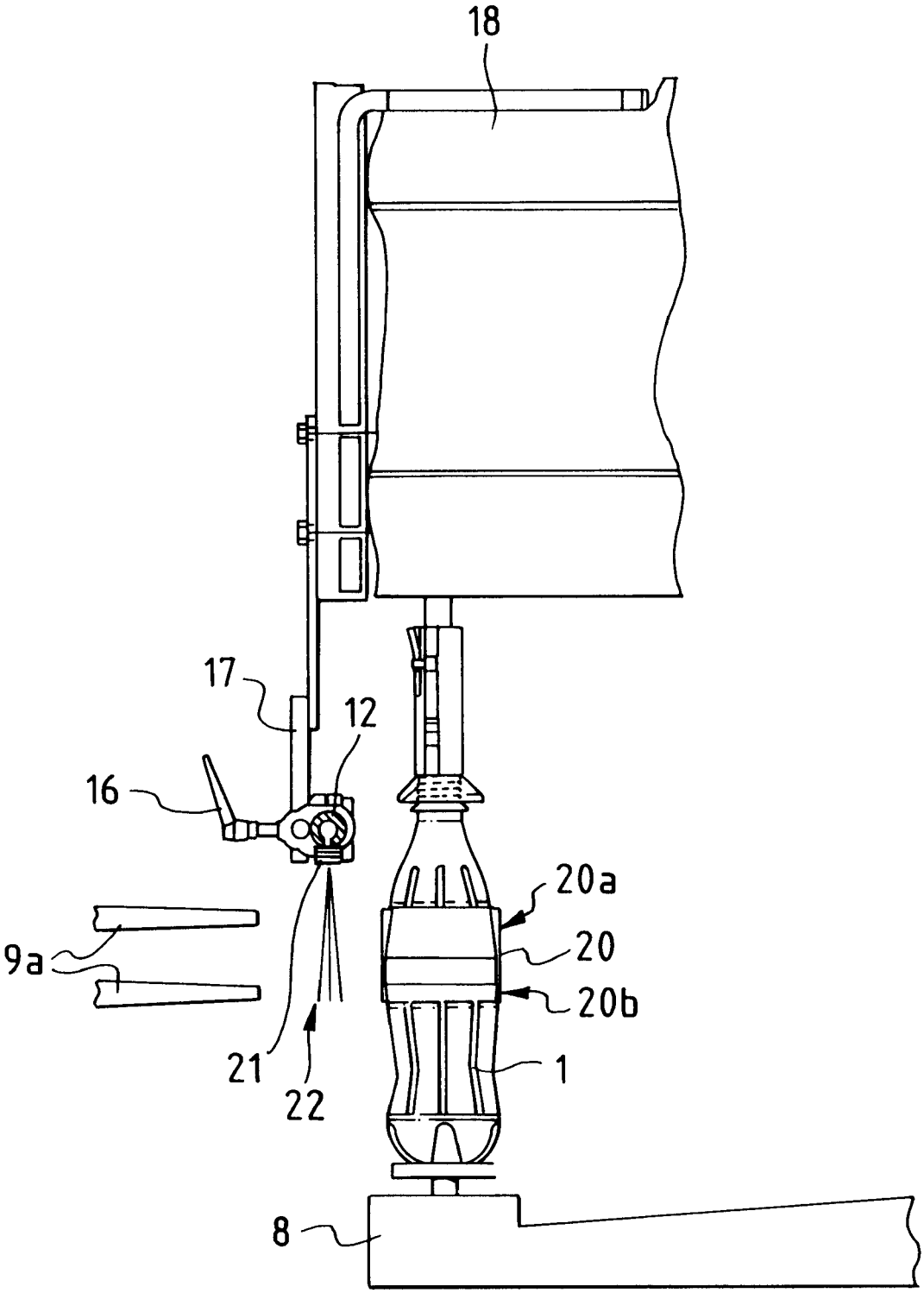
FIG. 3 a vertical, partial section A—A through the shrink device according to FIG. 2.

As can be seen in FIG. 3, the pipe 12 is located above the labeled region of the bottle 1, whereby the blower air flows out of the bore holes 21 directed downward and can form a curtain of air 22 between the bottle 1 and the slot nozzles 9*a*. A manually actuated clamp 16 fastens the pipe 12 to a mount 17 in a vertically movable manner, said mount being located at the stationary upper part 18 of the shrink carousel 8.

Instead of compressed air, another fluid such as water, for example, can also be used. The invention is not limited to the specified, exemplified embodiment, but devices designed differently can be used as long as they are suited to effect a controlled heat shielding between the containers that are to be handled and the heat source that is used.

Furthermore, the application of the invention is not limited to machines with a shrink carousel.

The invention can also be used in machines with a straight line container through-pass (see U.S. Pat. No. 4,447,280) in an appropriately adapted design.

What is claimed is:

1. A machine for handling containers comprising in combination, a heat source to shrink a wrapping material onto a container contour, and wherein a heat transfer from the heat source onto the wrapping material and the container can be interrupted between said heat source and the containers by means of a controlled heat shielding;

said heat source being formed as a hot air blower and said heat shielding being in a form of air flow generated from a blower device, whereby a curtain of air can be generated between the container and said hot air blower by means of said blower device;

a container conveyor on which said hot air blower is arranged, whereby said blower device is arranged along a length of said container conveyor and extends laterally parallel next to it, above a container area that bears the wrapping material, and between the hot air blower and the container;

said container conveyor being constructed as a carousel, on the radial outer side of which at least one said hot air blower is located, and which is surrounded by a concentrically curved and aligned pipe, advantageously from a container inflow to a container outflow of said carousel.

2. The machine according to claim 1, wherein said pipe is constructed as a section of arc of a circle with two ends, whereby one end features a supply and the other end features a closure.

3. The machine according to claim 2, wherein a plurality of said pipes are arranged in succession to one another.

* * * * *